US005509701A

United States Patent [19]

Reinhard

[11] Patent Number: 5,509,701

[45] Date of Patent: Apr. 23, 1996

[54] DOOR BRACING APPARATUS

[76] Inventor: Michael Reinhard, 1221 Bryant St., Fort Worth, Tex. 76126

[21] Appl. No.: 308,347

[22] Filed: Nov. 25, 1994

[51] Int. Cl.[6] ..... F05C 19/18

[52] U.S. Cl. ..... 292/259 R; 292/288

[58] Field of Search ..... 292/259 R, 288, 292/289, 346, 339

[56] References Cited

U.S. PATENT DOCUMENTS

| | | | |
|---|---|---|---|
| 3,819,216 | 6/1974 | Richardson | 292/259 R |
| 4,330,147 | 5/1982 | Nolen | 292/259 R |
| 4,529,235 | 7/1985 | Florentine, Sr. | 292/259 R |
| 5,014,527 | 5/1991 | Traller et al. | 292/259 R X |
| 5,127,689 | 7/1992 | Jarvis | 292/339 |
| 5,388,876 | 2/1995 | Saincome | 292/288 X |

*Primary Examiner*—Rodney M. Lindsey

*Attorney, Agent, or Firm*—Harrison & Egbert

[57] ABSTRACT

A door bracing apparatus including a crossbar, a striker member threadedly connected to the crossbar inwardly of a first end of the crossbar, and a stabilizer member threadedly connected to the crossbar inwardly of a second end of the crossbar. The striker member extends outwardly generally transverse to the crossbar so as to fit against a surface of a frame of the door. The stabilizer member extends outwardly generally transverse to the crossbar and in parallel corresponding relationship to the striker member. The stabilizer member serves to fit against an opposite surface of the frame of the door. The striker member includes a first plate having a front flat surface thereon, a second plate connected to the first plate and extending toward the crossbar, and a threaded member connected to the second plate and to the crossbar. The stabilizer member includes an L-shaped member, a support surface and a threaded shank affixed to the L-shaped member and threadedly received by the crossbar.

19 Claims, 2 Drawing Sheets

DOOR BRACING APPARATUS

TECHNICAL FIELD

The present invention relates generally to door bracing apparatus. More particularly, the present invention relates to apparatus that resist kick-ins, prying, and battering of a door. Additionally, the present invention relates to apparatus for resisting burglary.

BACKGROUND ART

Various techniques have been employed in the past for the locking of a door. Conventionally, doors are provided with a knob for the opening and closing of the door. Typically, the knob is connected to a door latch which moves inwardly and outwardly of a door latch hole formed on the frame of the doorway. Additionally, many doors are provided with a deadbolt for the strong locking of the door. A key is employed so as to actuate the deadbolt for the purpose of drawing the deadbolt into and out of a deadbolt hole formed on the frame of the doorway.

Under many circumstances, this arrangement is suitable for preventing intrusion through the door. However, it is still possible to penetrate through the door through the application of a strong kick to the exterior surface of the door. The application of a strong kick to the door can cause the deadbolt to crack or break the frame of the doorway. A properly placed kick can also cause the door latch to separate from the door latch hole. Whenever the frame of the door has been broken by the application of a kick, then intrusion through the door can easily occur.

Various bracing techniques have been employed in the past so as to resist such intrusion. One type of brace extends, at an angle, from the floor to the interior doorknob. As such, forces applied to the exterior of the door will be resisted by the brace. Unfortunately, this brace often extends within the interior of the dwelling. The door brace cannot be applied unless there is a person in the interior of the dwelling. Additionally, such a brace seldom properly withstands the force of a kick to the exterior of a door. As such, such braces have generally been of limited effectiveness in preventing kick-in type burglaries.

Chain locks and latches are often applied to the interior surface of the door so as to connect the door to the door frame. These items also have limited effectiveness since they can only be placed into their "locked" position by a person on the interior of the dwelling. Additionally, whenever the frame of the doorway is cracked by the application of the kicking force, then another kick can often dislodge such chains and/or latches from the frame of the door.

It is an object of the present invention to provide a bracing device that resists kick-in burglaries.

It is another object of the present invention to provide a door bracing apparatus that does not require a person to be on the interior of the dwelling.

It is another object of the present invention to provide a door bracing apparatus that is adaptable to the various sizes and depths of door frames.

It is another object of the present invention to provide a door bracing apparatus that will not require permanent attachment or fastening and can be easily removed from the door frame when not in use.

It is another object of the present invention to provide a door bracing apparatus that will not alter, modify or cause change to the original configuration and construction of the door itself and specifically the door frame.

It is another object of the present invention to provide a door bracing apparatus that will not necessarily require a dead bolt for effective use.

It is still another object of the present invention to provide a door bracing apparatus that is easy to use, easy to install, easy to manufacture, and relatively inexpensive.

These and other objects and advantages of the present invention will become apparent from a reading of the attached specification and appended claims, thus positioned horizontally on the exterior side of the door frame.

SUMMARY OF THE INVENTION

The present invention is an apparatus for the bracing of a door and, more particularly, for the bracing of a door for the purpose of resisting kick-in burglaries. The door bracing apparatus of the present invention should be applied to a door frame having an interior opening for receiving a door. The door frame should have a locking hole side and a hinge side. The door frame has a first jamb extending along a surface of the locking hole side and a second jamb extending along a surface of the hinge side. The door bracing apparatus of the present invention is applied between the surfaces of the locking hole side and the hinge side, thus positioned horizontally on the exterior side of the door.

The door bracing apparatus of the present invention includes a crossbar having a length greater than a width of the interior opening of the door. A striker member is connected to the crossbar inwardly of the first end of the crossbar. The striker member extends outwardly from the crossbar. The striker member is in surface-to-surface contact with the surface of the locking hole side. The striker member has an opening corresponding to the locking hole on the locking hole side.

The stabilizer member is connected to the crossbar inwardly of an opposite end of the crossbar. This stabilizer member extends outwardly therefrom. The stabilizer member is in surface-to-surface contact with the surface of the hinge side.

The striker member has an L-shaped portion in abutment with the first jamb. The stabilizer member has an L-shaped portion in abutment with the second jamb. The striker member and the stabilizer member are threadedly connected to the crossbar. The striker member extends outwardly generally transverse to the crossbar. The stabilizer member also extends outwardly generally transverse to the crossbar. The striker member is in generally parallel relationship to the stabilizer member. The striker member can have a second opening positioned below and vertically aligned with the first opening on the striker member. The striker member has a length which is greater than a width of the crossbar. The striker member has a lip that is formed along an edge of the striker member opposite the crossbar.

In one embodiment of the present invention, the crossbar can include a first tubular member and a second tubular member slidably received within the first tubular member. A setscrew can be employed for fixing the position of the first tubular member with respect to the second tubular member.

DETAILED DESCRIPTION OF THE INVENTION

Figure 1:
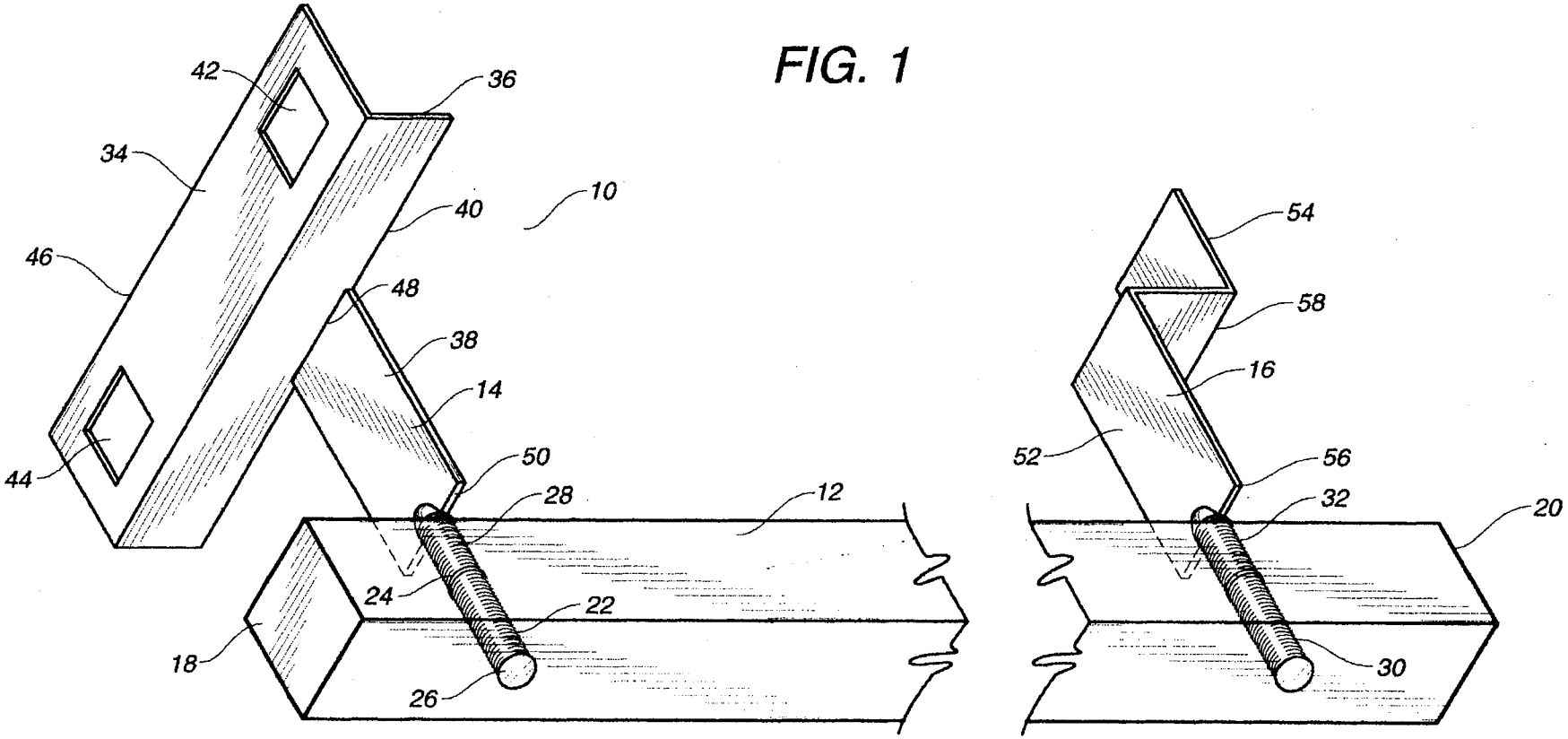
FIG. 1 is a perspective view of the door bracing apparatus in accordance with the preferred embodiment of the present invention.

Referring to FIG. 1, there is shown at 10 the door bracing apparatus in accordance with the preferred embodiment of the present invention. The door bracing apparatus 10 includes a crossbar 12, a striker member 14, and a stabilizer member 16. The striker member 14 is threadedly connected to the crossbar 12 inwardly of a first end 18 of the crossbar 12. The stabilizer member 16 is threadedly connected to the crossbar 12 inwardly of an opposite end 20 of the crossbar 12.

Figure 2:
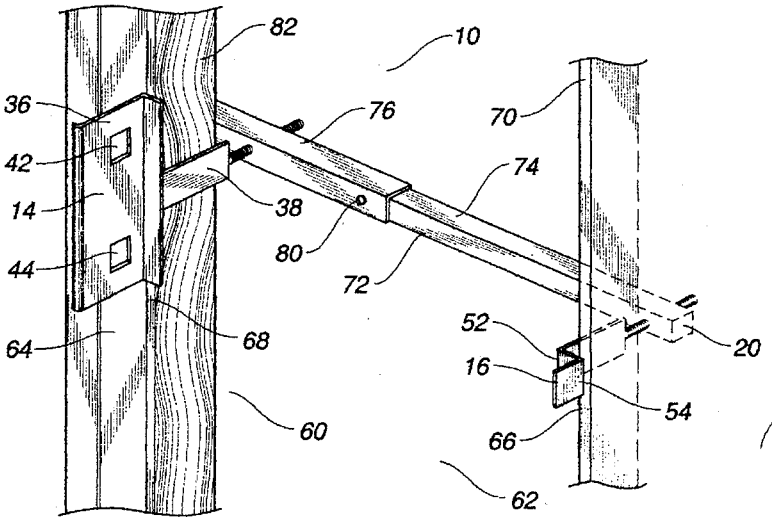
FIG. 2 shows the application of the door bracing apparatus of the present invention as applied to a door frame.

As shown in FIG. 1, the crossbar 12 is a square rigid tubular member which has a length greater than a width of the door. Typically, with respect to conventional doors, the crossbar 12 will have a length of greater than three feet. As shown in FIG. 1, the crossbar 12 is of a unitary construction. However, it is possible within the concept of the present invention that the tubular member 12 can be made up of a pair of tubular members, one being slidably nested within the other (as illustrated in FIG. 2). This facilitates the ability of the apparatus 10 to fit various sizes of doors and door frames. A threaded cylinder 22 is affixed so as to have one open end 24 and another end 26 at the surfaces of the crossbar 12. The threaded cylindrical member 22 has a thread structure which is suitable for receiving the threaded member 28 extending outwardly from the striker member 14. The threaded cylindrical member 22 can be welded, or otherwise affixed, to the cross-sectional interior of the crossbar 12. Similarly, another threaded cylindrical member 30 is provided for the receipt of the threaded shank 32 of the stabilizer member 16. This threaded cylindrical member 30 is affixed within the crossbar 12 inwardly of the end 20.

The striker member 14 extends outwardly generally transverse to the crossbar 12. The striker member 14 has a surface 34 for fitting against a surface of a frame of the door. The striker member 14 includes a first plate 36, a second plate 38, and the threaded member 28. The flat surface 34 is formed on the first plate 36. The first plate 36 is an L-shaped member. One end 40 of the L-shaped member 36 is connected to the second plate 38. The first plate 36 has a length which is greater than a width of the crossbar 12. The surface 34 is in offset planar parallel relationship to the second plate 38. The surface 34 has a first opening 42 formed therethrough. A second opening 44 is also formed in the surface 34. The second opening 44 is positioned below and vertically aligned with the first opening 42 on the surface 34. A lip 46 is formed on an edge of the first plate 36 opposite the second plate 38. The lip 46 is curved so as to extend rearwardly of the surface 34. The first plate 36 is integrally connected to the second plate 38.

The second plate is a flat planar member that is connected at edge 48 to the first plate 36. The threaded member 28 is connected to the edge 50 of the second plate 38. The threaded member 28 is rotatably connected to the threaded cylindrical member 22 of the crossbar 12 so as to vary a distance of the surface 34 from the crossbar 12. As will be described hereinafter, the rotation of the threaded member 28 within the threaded cylindrical member 22 allows the surface 34 to be extended inwardly or outwardly from the crossbar 12. Likewise, and as described below, the rotation of the threaded shank 32 within the threaded cylindrical member 30 allows the support surface 54 to be extended inwardly or outwardly from the crossbar 12. This facilitates the ability of the apparatus 10 to fit various sizes of door frames.

The stabilizer member 16 includes the threaded shank 32, an L-shaped member 52, and a support surface 54. The threaded shank 32 is affixed at one end to the edge 56 of the L-shaped member 52 and is threadedly received by the threaded cylindrical member 30 within the crossbar 12. The support surface 54 extends outwardly from an end 58 of the L-shaped member 52 opposite the threaded shank 32. The support surface 54 is in offset planar parallel relationship to the threaded shank 32. The support surface 54 and the L-shaped member 52 can be integrally formed together. The threaded receipt of the threaded shank 32 within the threaded cylindrical member 30 allows the distance of the support surface 54 to be adjusted with respect to the position of the crossbar 12.

The striker member 14 is arranged in generally parallel relationship to the stabilizer member 16. The striker member 14 and the stabilizer member 16 each extend outwardly transverse to the longitudinal axis of the crossbar 12. In a conventional application to a standard size of door, the striker member 14 will be separated from the stabilizer member 16 by a distance of no more than three feet.

FIG. 2 illustrates the positioning of the door bracing apparatus 10 of the present invention within a door frame 60. The door frame 60 includes an interior opening 62 for receiving a door therein. The door frame 60 has a locking hole side 64 and a hinge side 66. The door frame 60 has a first jamb 68 extending along a surface of the locking hole side 64. A second jamb 70 extends along a surface of the hinge side 66.

As illustrated in FIG. 2, the crossbar 72 has a slightly different configuration than that of the crossbar 12 of FIG. 1. The crossbar 72 includes a first tubular member 74 and a second tubular member 76. The first tubular member 74 is slidably received within the interior of the second tubular member 76. As such, the distance between the striker member 14 and the stabilizer member 16 can be varied, as required, to fit the distance between the locking hole side 64 and the hinge side 66 of door frame 60. A set screw 80 is provided on the second tubular member 76 so as to fix the position of the first tubular member 74 with respect to the second tubular member 76.

Importantly, in FIG. 2, it can be seen that the crossbar 72 has a length which is greater than the opening 62 of the door frame 60. As such, the end 20 will extend beyond the edge of the hinge side 66 of the door frame 60. The opposite end 18 (not shown in FIG. 2) will extend outwardly beyond the edge of the locking hole side 64 of the door frame 60.

The striker member 14 extends such that the second plate 38 is adjacent to the surface 82 of the door frame 60. The L-shaped member 36 will extend downwardly so as to be generally adjacent to the jamb 68 of the locking hole side 64. The surface 34 of the L-shaped member 36 will be in surface-to-surface contact with the locking hole side 64. The first opening 42 or the second opening 44 is aligned so as to correspond with the deadbolt hole or door latch hole on the locking hole side 64. The first opening 42 of the striker member 14 is used for right hinged door frames, as shown in FIG. 2. Conversely, the second opening 44 of the striker member 14 is used for left hinged door frames.

The stabilizer member 16 has its L-shaped member 52 extending along the inner surface of the hinge side 66 and along the second jamb 70. The support surface 54 extends outwardly from the second jamb 70.

Figure 3:
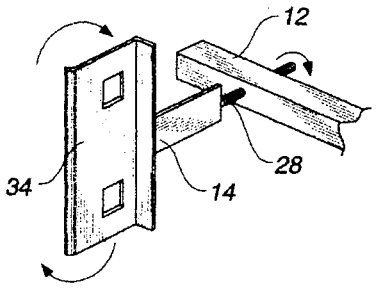
FIG. 3 is a detailed view of the door bracing apparatus of the present invention showing the adjustment of the striker member.

FIG. 3 shows that the distance of the surface 34 from the crossbar 12 can be varied by rotating the striker member 14 in one direction or the other. It can be seen that the threaded member 28 will rotate relative to the crossbar 12. When the striker member 14 is rotated in one direction, then the surface 34 will extend outwardly a greater distance from the crossbar 12. When the striker member 14 is rotated in the other direction, then the surface 34 will draw toward the crossbar 12. As such, the door bracing apparatus 10 of the present invention is adaptable to various sizes and depths of door frames and their exterior surfaces. Conversely, the stabilizer member 16 can be adjusted in the same manner.

Figure 4:
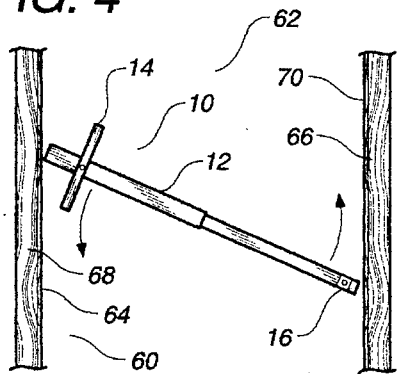
FIG. 4 is a front elevational view showing the deployment of the door bracing apparatus of the present invention to a door frame.

FIG. 4 shows an illustration of the installation of the door bracing apparatus 10. Initially, the crossbar 12 is positioned at an angle, relative to the vertical, within the doorway 62 of the door frame 60. The crossbar 12 is rotated so that the striker member 14 will be placed into surface-to-surface contact with the locking hole side 64 of the door frame 60. At the same time, the stabilizer member 16 will move upwardly so as to be surface-to-surface contact with the hinge side 66 of the door frame 60.

Figure 5:
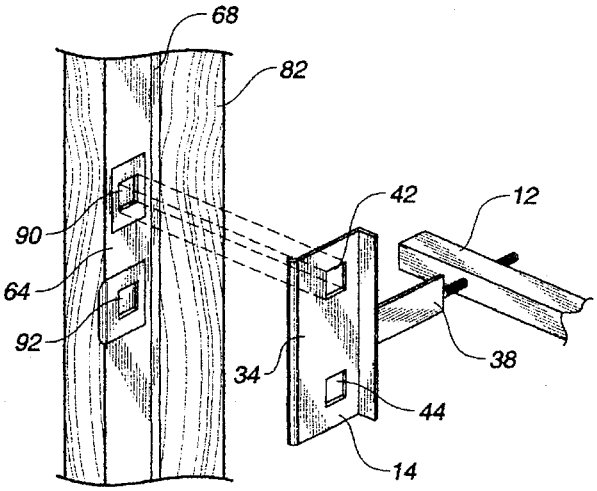
FIG. 5 is a detailed perspective view showing a positioning and alignment of the door bracing apparatus of the present invention.

In FIG. 5, the striker member 14 is shown as having its openings 42 or 44 in a position so as to be aligned with the deadbolt hole 90 or with the door latching hole 92 on the locking hole side 64 of the door frame 60. It can be seen that the opening 42 is configured in a rectangular configuration so as to generally match the configuration of the deadbolt hole 90 or door latching hole 92. When the striker member 14 is positioned in juxtaposition with the surface of the locking hole side 64, the opening 42 or 44 will be aligned with the deadbolt hole 90 or the door latching hole 92. The deadbolt and door latch of the door can be operated in a conventional manner.

Prior to the installation of the door bracing apparatus 10, the striker member 14 is adjusted so that a portion of the depth or thickness of the door frame 60 becomes firmly sandwiched between the first plate 36 of the striker member 14 and the first end 18 of the crossbar 12. The striker member 14 is adjusted by rotating striker member 14 in a clockwise direction to close or a counter-clockwise direction to open. The stabilizer member 16 can be adjusted in a similar manner.

To mount the door bracing apparatus 10, the door should be opened about three-fourths of the way. The crossbar 12 is held in a diagonal position with both hands. One hand should be near or holding the striker member 14 and the other hand should be near or holding the stabilizer member 16. Once the crossbar 12 is in a diagonal position, the crossbar 12 should be slightly pulled toward the holder until the outside corner of the surface 34 of the first plate 36 of the striker member 14 clears the door jamb 68. The crossbar 12 may be rotated in a clockwise or counter-clockwise direction until it is approximately level. The striker member 14 should be moved upwardly or downwardly so that the square deadbolt opening 42 or 44 aligns with the existing deadbolt hole 90 or door latch hole 92 of the door frame 60. If the striker member 14 and the stabilizer member 16 were adjusted properly, the door bracing apparatus 10 will support itself in a proper position when the crossbar 12 is released. The door can be shut when the deadbolt opening 42 or 44 is aligned with the deadbolt hole 90 or door latch hole 92. The door is then locked in the usual manner.

In certain circumstances, it may be difficult to keep the striker member 14 or the stabilizer member 16 in place. As such, it may be difficult to keep the square deadbolt opening 42 or 44 properly aligned with the deadbolt hole 90 or the door latch hole 92 of the door frame 60 while attempting to shut the door. If this happens, then it is necessary to readjust, that is, tighten or close the striker member 14 and/or the stabilizer member 16 a little further so that the crossbar 12 rests securely against the exterior surface of the door frame or portion of exterior wall.

The present invention effectively prevents the kicking in of the door. The crossbar 12 will extend across the exterior of the door frame 60. It is important to emphasize that the crossbar 12 never comes in contact with the exterior surface of the door. The crossbar 12 will be in a proper position so as to resist centralized kicks to the door. The crossbar 12 will also resist prying, ramming and battering of the door. If any type of force applied to the door above or below the crossbar 12, then the applied force will cause the deadbolt shaft to exert a force against the striker member 14, thus pulling the crossbar 12 in the same direction of the force. The striker member 14 will have a tendency to move slightly toward the interior of the dwelling. However, the strength of the striker member 14 will resist such force, thus preventing the fracturing of the door frame 60 or the forced opening of the door. Furthermore, the crossbar 12 will move into abutment with the exterior surfaces of the door frame 60. As such, the crossbar 12 will resist further movement of the striker plate toward the interior of the dwelling. Since the door bracing apparatus 10 prevents the fracturing of the door frame or the release of the deadbolt of the door, the kick-in attempt or any other type of force, is effectively thwarted. Since both the striker member 14 and the stabilizer member 16 are threadedly attached to the crossbar 12, it is not possible to remove the crossbar 12 without access to the striker member 14 or to the stabilizer member 16. When the door is closed, access to these members is prevented.

In some circumstances, the door latch hole 92 will not be so perfectly aligned with the deadbolt hole 90 so as to allow the use of both openings 42 and 44 on the striker member 14 simultaneously. In such a circumstance, the striker member 14 can be moved upwardly or downwardly so that only one of the openings 42 and 44 aligns with the deadbolt hole 90. Alternatively, if the door does not have a deadbolt hole, then one of the openings 42 or 44 can be positioned over the door latch hole 92.

The present invention can be modified in several ways. For example, the crossbar 12 can be either a pair of nested tubular members or it can be a single member. The striker member 14 can have one or both of the openings 42 or 44. The support surface 54 on the stabilizer member 16 is essential to the proper functioning of the present invention.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A door bracing apparatus comprising:

a crossbar;

a striker means threadedly connected to said crossbar inwardly of a first end of said crossbar, said striker means extending outwardly generally transverse to said crossbar, said striker means for fitting against a surface of a frame of the door, said striker means comprising:

a first plate having a flat surface thereon;

a second plate connected to said first plate and extending toward said crossbar; and a threaded member connected to said second plate and to said crossbar, said threaded member rotatably connected to said crossbar so as to vary a distance of said first plate from said crossbar; and a stabilizer means threadedly connected to said crossbar inwardly of a second end of said crossbar, said stabilizer means extending outwardly generally transverse to said crossbar and in generally parallel relationship to said striker means, said stabilizer means for fitting against an opposite surface of the frame of the door.

2. The apparatus of claim 1, said crossbar being of a rigid material, said crossbar comprising:

a first tubular member;

a second tubular member slidably received within said first tubular member; and a means for fixing a position of said first tubular member with respect to said second tubular member.

3. The apparatus of claim 1, said first plate being in offset planar parallel relationship to said second plate.

4. The apparatus of claim 1, said first plate having a first opening formed therethrough.

5. The apparatus of claim 4, said first plate having a second opening positioned below and vertically aligned with said first opening.

6. The apparatus of claim 5, each of said first and second openings having a generally rectangular configuration.

7. The apparatus of claim 1, said first plate having a lip formed thereon and curved so as to extend rearwardly of said first plate opposite said second plate, said first plate being integrally connected to said second plate.

8. The apparatus of claim 1, said stabilizer means comprising:

an L-shaped member; and a threaded shank affixed to said L-shaped member and threadedly received by said crossbar.

9. The apparatus of claim 8, said stabilizer means further comprising:

a support surface extending outwardly from an end of said L-shaped member opposite said threaded shank.

10. The apparatus of claim 1, said crossbar having a length of greater than three feet, said striker means and said stabilizer means being separated by no more than three feet.

11. The apparatus of claim 1, said first plate being an L-shaped member, one end of said L-shaped member connected to said second plate, said first plate having a length greater than a width of said crossbar.

12. A door bracing apparatus comprising:

a crossbar;

a striker means threadedly connected to said crossbar inwardly of a first end of said crossbar, said striker means extending outwardly generally transverse to said crossbar, said striker means for fitting against a surface of a frame of the door; and a stabilizer means threadedly connected to said crossbar inwardly of a second end of said crossbar, said stabilizer means extending outwardly generally transverse to said crossbar and in generally parallel relationship to said striker means, said stabilizer means for fitting against an opposite surface of the frame of the door, said crossbar being a rigid tubular member having a length greater than a width of the door.

13. An apparatus comprising:

a door frame having an interior opening for receiving a door, said door frame having a locking hole side and a hinge side, said door frame having a first jamb extending along a surface of said locking hole side and a second jamb extending along a surface of said hinge side;

a crossbar having a length greater than a width of said interior opening of said door frame;

a striker member is connected to said crossbar inwardly of a first end of said crossbar and extending outwardly therefrom, said striker member being in surface-to-surface contact with said surface of said locking hole side, said striker member having an opening corresponding to a locking hole on said locking hole side; and a stabilizer member connected to said crossbar inwardly of a second end of said crossbar and extending outwardly therefrom, said stabilizer means being in surface-to-surface contact with the surface of said hinge side.

14. The apparatus of claim 13, said striker member having a length greater than a width of said crossbar, said striker member having a lip formed along an edge opposite said crossbar.

15. The apparatus of claim 13, said striker member having an L-shaped portion in abutment with said first jamb, said stabilizer member having a L-shaped portion in abutment with said second jamb.

16. The apparatus of claim 13, said striker member being threadedly connected to said crossbar, said stabilizer member being threadedly connected to said crossbar.

17. The apparatus of claim 13, said striker member extending outwardly generally transverse to said crossbar, said stabilizer member extending outwardly generally transverse to said crossbar, said striker member being in generally parallel relationship to said stabilizer member.

18. The apparatus of claim 13, said striker member having another opening positioned below and vertically aligned with said opening corresponding to the locking hole on said striker member.

19. The apparatus of claim 13, said crossbar comprising:

a first tubular member; and a second tubular member slidably received within said first tubular member.

* * * * *